US011204151B2

(12) United States Patent
Itahana et al.

(10) Patent No.: US 11,204,151 B2
(45) Date of Patent: Dec. 21, 2021

(54) OPTICAL DEVICE AND ILLUMINATION DEVICE

(71) Applicant: NICHIA CORPORATION, Anan (JP)

(72) Inventors: Hiroyuki Itahana, Okaya (JP); Takanori Aruga, Suwa-gun (JP); Wataru Kitahara, Kamiina-gun (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/125,614

(22) Filed: Dec. 17, 2020

(65) Prior Publication Data

US 2021/0199267 A1 Jul. 1, 2021

(30) Foreign Application Priority Data

Dec. 27, 2019 (JP) ..... JP2019-238924

(51) Int. Cl.
*F21V 7/04* (2006.01)
*F21V 5/04* (2006.01)

(52) U.S. Cl.
CPC ..... *F21V 7/04* (2013.01); *F21V 5/045* (2013.01)

(58) Field of Classification Search
CPC . F21V 7/04; F21V 7/045; F21V 7/046; F21V 7/048; F21V 7/09; F21V 5/045
See application file for complete search history.

(56) References Cited

U.S. PATENT DOCUMENTS 4,096,555 A * 6/1978 Lasker ..... F21S 8/086 362/296.07
5,931,569 A * 8/1999 Anderson ..... F21V 7/09 362/346
2005/0024744 A1* 2/2005 Falicoff ..... G02B 19/0061 359/737
2006/0023457 A1* 2/2006 Leadford ..... F21V 7/04 362/297
2008/0291685 A1* 11/2008 Misawa ..... F21V 7/0091 362/459
2015/0117021 A1* 4/2015 Chinniah ..... G02B 19/0028 362/294
2018/0227990 A1* 8/2018 Nakamura ..... B60Q 3/16

FOREIGN PATENT DOCUMENTS

JP 2011-065831 A 3/2011
JP 2012-074278 A 4/2012
JP 2014-102973 A 6/2014
JP 2014-102995 A 6/2014
JP 2015-159075 A 9/2015

* cited by examiner

*Primary Examiner* — Bryon T Gyllstrom
*Assistant Examiner* — Christopher E Dunay
(74) *Attorney, Agent, or Firm* — Foley & Lardner LLP

(57) ABSTRACT

An optical device includes: a light-transmissive member having a first reflective surface configured to reflect, to an arc-shaped first region around a first axis, first light incident along the first axis and having a light distribution characteristic with an optical axis parallel to the first axis; and a reflector having: a second reflective surface and a third reflective surface intersecting each other on the first axis and disposed such that the first reflective surface is located between the second reflective surface and the third reflective surface; and a fourth reflective surface disposed between the second reflective surface and the third reflective surface to reflect the first light to the arc-shaped first region around the first axis.

14 Claims, 6 Drawing Sheets

FIG. 2A
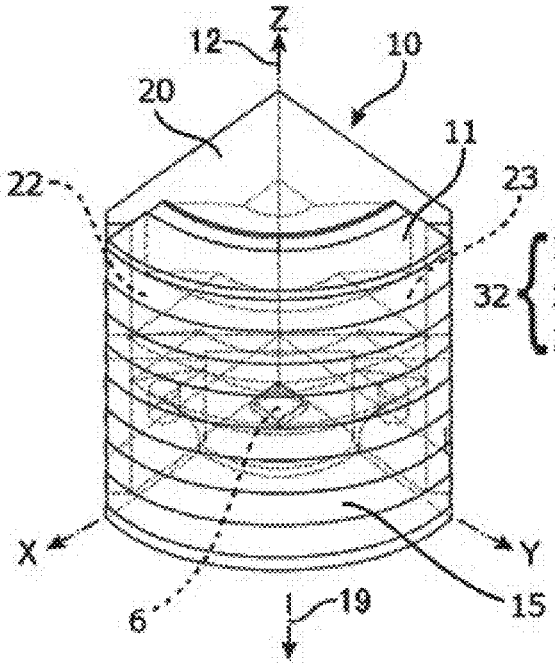
FIG. 2B
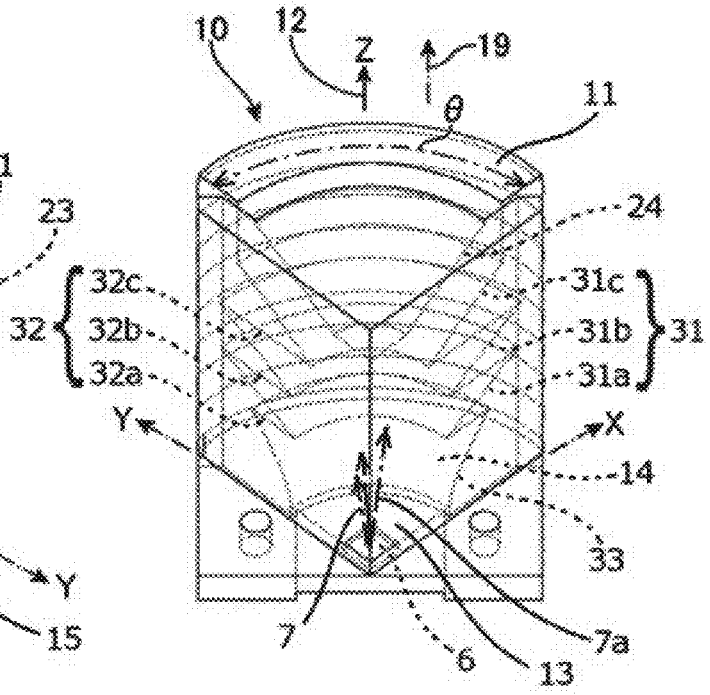
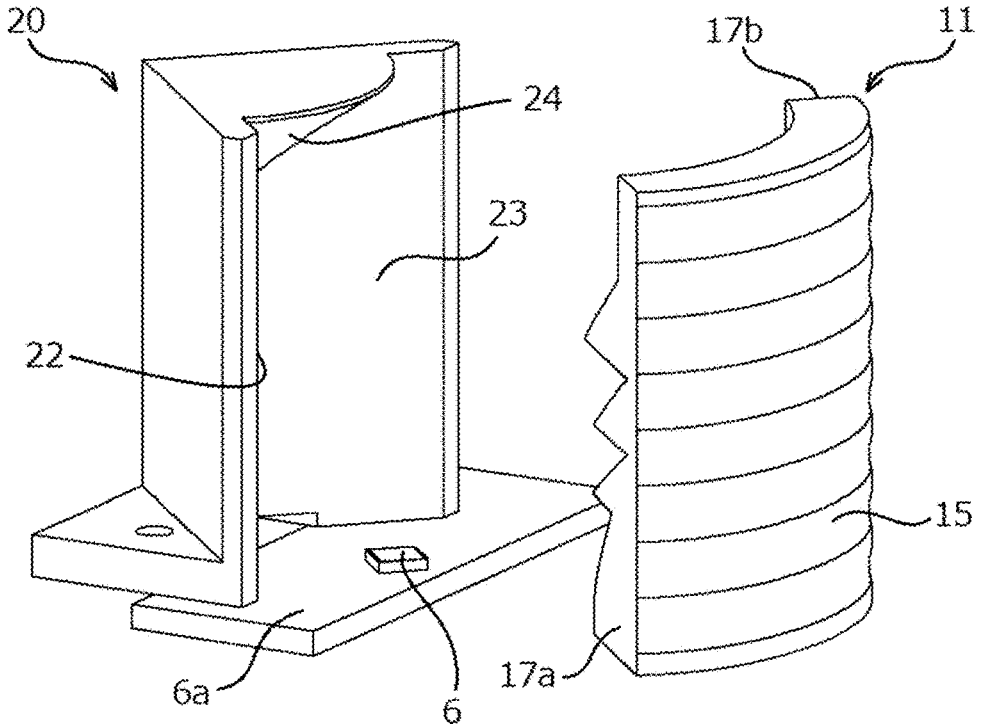
FIG. 3

OPTICAL DEVICE AND ILLUMINATION DEVICE

CROSS-REFERENCE TO RELATED APPLICATION

This application claims priority to Japanese Patent Application No. 2019-238924, filed on Dec. 27, 2019, the entire contents of which are hereby incorporated by reference.

BACKGROUND OF THE INVENTION

1. Field of the Invention

The present invention relates to an optical device and an illumination device employing the optical device.

2. Description of Related Art

Japanese Patent Publication No. 2012-074278 discloses an illumination device that can illuminate a linear irradiation region using a small number of light source modules.

SUMMARY

Light emitted from an LED generally has a Lambertian light distribution, which is a light distribution pattern in which the luminous intensity is highest on the optical axis. In order to illuminate a long linear irradiation region using a large number of densely arranged illumination devices or a small number of illumination devices, the light distribution is required to be controlled by varying the angles of a large number of optical axes of the large number of densely arranged LEDs to disperse light along the linear region to be illuminated or by performing different types of complicated processing between light illuminating an end portion of the line and light illuminating a central portion of the line on optical axes that are set obliquely across the linear region. Accordingly, there is a demand for an optical device configured to convert a Lambertian light distribution into a linear or quadrangular light distribution.

An optical device according to an embodiment of the present disclosure includes a light-transmissive member having a first reflective surface disposed to reflect, to an arc-shaped first region around a first axis, first light incident along the first axis and having a light distribution characteristic with an optical axis parallel to the first axis, and a reflector having a second reflective surface and a third reflective surface intersecting each other on the first axis and disposed such that the first reflective surface is located between the second reflective surface and the third reflective surface, and a fourth reflective surface disposed between the second reflective surface and the third reflective surface to reflect the first light to the arc-shaped first region around the first axis.

An illumination device according to an embodiment of the present disclosure includes the optical device according to the embodiment of the present disclosure and a light source configured to emit the first light.

Certain embodiments of the present invention allow for providing an optical device and an illumination device that can convert light having a Lambertian light distribution into light having a more uniform linear or quadrangular luminous intensity distribution before emitting the light.

BRIEF DESCRIPTION OF THE DRAWINGS

FIG. 2A schematically shows the illumination device when viewed from the front (the direction of radiation).

FIG. 2B schematically shows the illumination device from a side of the Z-axis.

FIG. 3 is a schematic exploded view of the illumination device.

FIGS. 9A to 9C schematically show different examples of the relationship between a region to be illuminated and a light-transmissive member, in which FIG. 9A is a schematic cross-sectional view of an optical element appropriate for illumination of a U-shaped region, FIG. 9B is a schematic cross-sectional view of a light-transmissive member appropriate for illumination of a V-shaped region, and FIG. 9C is a schematic cross-sectional view of a light-transmissive member appropriate for illumination of an L-shaped region.

DETAILED DESCRIPTION

Figure 1:
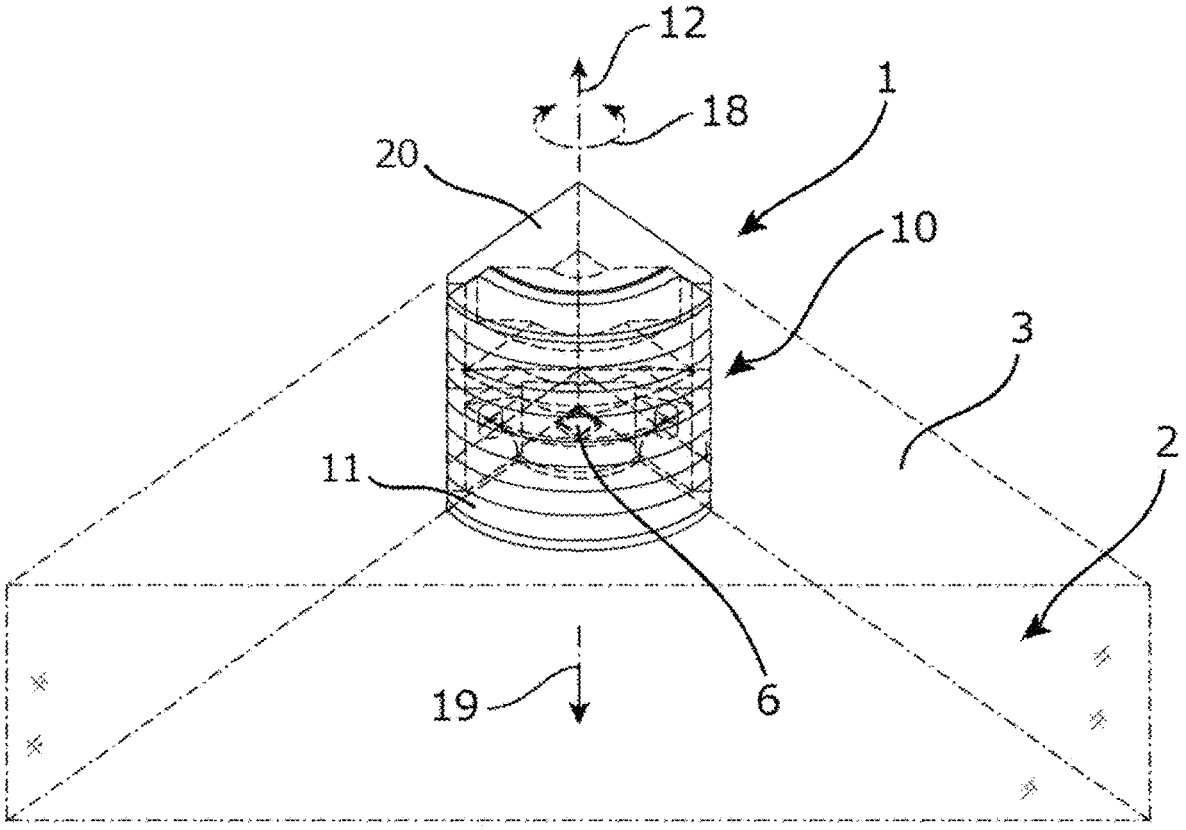
FIG. 1 is a schematic perspective view of an example of an illumination device.

An optical device and an illumination device according to embodiments of the present invention will be described referring to the accompanying drawings. In the description below, examples of an optical device and an illumination device are described to give a concrete form to the technical ideas of the present invention. However, the present invention is not limited to the examples described below. Unless specifically stated otherwise, the sizes, materials, shapes, and relative positions of components described in the embodiments are not intended to limit the scope of the present invention, but are described as examples. Sizes or positional relations of members illustrated in the drawings may be exaggerated in order to clarify the descriptions. In the descriptions below, the same term or reference numeral represents the same member or a member made of the same material, and its detailed description will be omitted as appropriate.

FIG. 1 schematically shows an example of an illumination device according to one embodiment. An illumination device 1 can cast or project, to a front 19, light 3 controlled so as to illuminate a quadrangular or linear region 2 such as the top of a desk. The illumination device 1 includes an optical device 10 including a light-transmissive member 11 and a reflector 20 and an LED 6 that casts light on an end surface of the light-transmissive member 11. The illumination device 1 may include a driver circuit that operates the LED 6.

As shown in FIGS. 2A and 2B, the light-transmissive member 11 is made of a light-transmissive member such as an acrylic resin and glass formed into a substantially fan shape that spreads at an angle θ (central angle θ or opening angle θ) around a first axis (Z-axis) 12, which is the central axis, in a plan view in a plane (X-Y plane) orthogonal to the Z-axis 12. In the light-transmissive member 11 having a columnar shape extending along the Z-axis 12 as a whole, a space 14 having an opening 13 at an end of the Z-axis 12 (on the bottom surface side or in the negative direction of the Z-axis) presents near the Z-axis 12 (inside), and a surface (emission surface) 15 on the opposite projection side (front or outer side) 19 is substantially arc-shaped.

The optical device 10 includes the reflector 20 having a second reflective surface 22 and a third reflective surface 23 arranged such that the light-transmissive member 11 is located therebetween. The second reflective surface 22 and the third reflective surface 23 are reflective surfaces that intersect each other on the Z-axis 12 and are disposed such that the light-transmissive member 11 is located therebetween. The reflector 20 further has a fourth reflective surface 24 disposed between the second reflective surface 22 and the third reflective surface 23 to reflect first light 7 to an arc-shaped first region around the first axis 12.

The reflector 20 may be made of a metal material such as stainless steel or aluminum, an organic material such as a resin provided with a reflective film on its surface, or an inorganic material such as ceramic. The reflective film may be a film formed by vapor deposition or the like of metal or a material having a reflection property itself, a laminate of a plurality of thin films having different refractive indices such that predetermined reflection properties are obtained, or another thin film having a structure offering predetermined reflection properties. The reflectances of the second reflective surface 22, the third reflective surface 23, and the fourth reflective surface 24 can be selected according to the intended use or the like of the illumination device 1, and either specular surfaces or diffuse reflecting surfaces may be employed.

Figure 4:
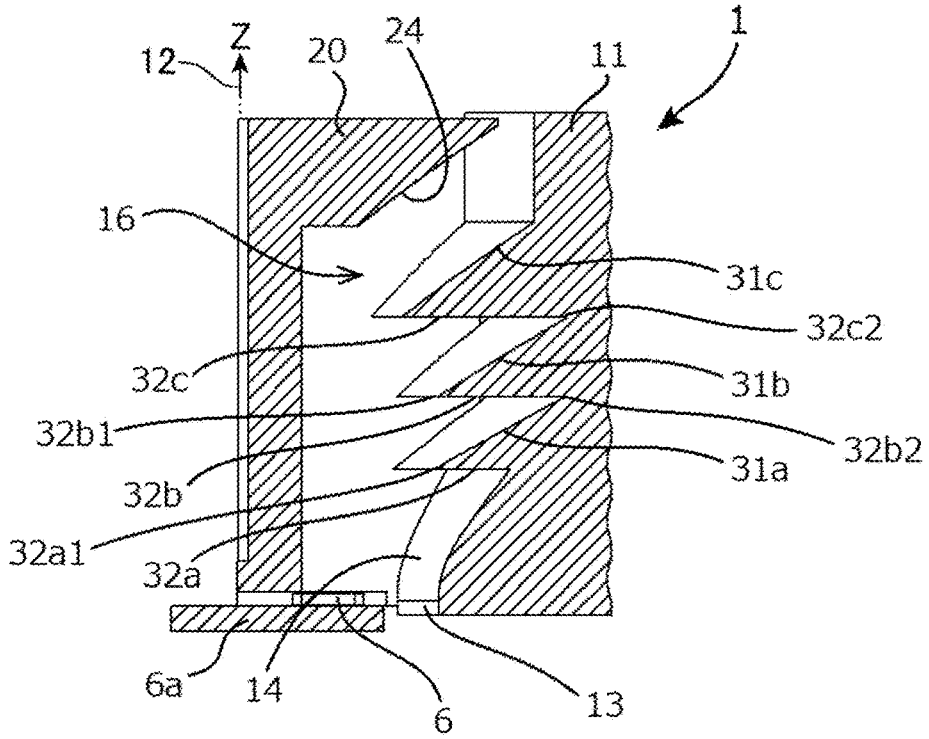
FIG. 4 is a schematic cross-sectional view showing the structure of the illumination device.

As shown in the schematic cross-sectional view of FIG. 4, the light-transmissive member 11 is a lens having the space 14 along the Z-axis 12 inside as a whole and has a multilevel inner surface (transmissive/reflective surface) 16 including transmissive surfaces 32*a* to 32*c* and reflective surfaces 31*a* to 31*c* alternately arranged along the Z-axis 12 from the opening 13 side of the space 14.

The inner surface of the light-transmissive member 11 includes a plurality of fan-shaped transmissive surfaces 32 (32*a* to 32*c*) forming coaxial arcs disposed stepwise from the opening 13 toward a side opposite to the opening 13, that is, from the negative side toward the positive side of the Z-axis 12, and a plurality of arc-shaped first reflective surfaces 31 (31*a* to 31*c*) separated from each other by the transmissive surfaces 32 (32*a* to 32*c*) and broadening along the Z-axis 12 at acute angles with the X-Y plane. The inner surface of the light-transmissive member 11 includes the fan-shaped transmissive surfaces 32*a* to 32*c* that are arranged sequentially to form coaxial arcs with the thickness of the X-Y plane gradually increasing from the opening 13 toward the side opposite to the opening 13, that is, from the negative side toward the positive side of the Z-axis 12. A plurality of fan-shaped transmissive surfaces of the same or substantially the same shapes may be arranged to form coaxial arcs.

FIG. 3 is a schematic exploded view of the illumination device. As shown in FIG. 3, the fourth reflective surface 24 of the reflector 20 is located above the intersection of the second reflective surface 22 and the third reflective surface 23. Similar to the first reflective surfaces 31 of the light-transmissive member 11, the fourth reflective surface 24 is an arc-shaped reflective surface broadening at an acute angle with the X-Y plane to form a substantially fan-shaped inverted truncated cone. The fourth reflective surface 24 is located farther from the LED 6 than the first reflective surfaces 31. That is, the first reflective surfaces 31 are located closer to the incident side than the fourth reflective surface 24. The second reflective surface 22, the third reflective surface 23, and the fourth reflective surface 24 do not have to be integrated but are preferably integrated because the number of components is reduced.

FIGS. 2A and 2B schematically show the illumination device. FIG. 2A is a schematic perspective view of the optical device 10 when viewed from the projection side (front side) 19. FIG. 2B is a schematic perspective view of the optical device 10 when viewed from the side opposite to the projection side 19.

Specifically, the first reflective surfaces 31 of the light-transmissive member 11 in the present example include three reflective surfaces (first reflective surfaces) 31*a* to 31*c* separated from each other by three transmissive surfaces 32*a* to 32*c* that are perpendicular to the Z-axis 12 from the opening 13 side (the lower side or the negative direction of the Z-axis) toward the side opposite to the opening 13, that is, from the negative side toward the positive side of the Z-axis 12, and that are parallel to the X-Y plane. That is, the light-transmissive member 11 has the three transmissive surfaces 32*a* to 32*c* and the three reflective surfaces (first reflective surfaces) 31*a* to 31*c* alternately arranged from the negative side toward the positive side of the Z-axis 12. The light-transmissive member 11 further has an arc-shaped transmissive surface 33 around the Z-axis 12 in the lowermost portion of the multilevel inner surface closest to the incident side, that is, closest to the opening 13. The transmissive surface 33 transmits a portion of the first light.

Accordingly, the light-transmissive member 11 has the fan-shaped transmissive surfaces 32*a*, 32*b*, and 32*c* discontinuously and sequentially arranged along the first axis (Z-axis) 12 to form coaxial arcs such that the thickness of the light-transmissive member 11 in the X-Y plane gradually increases from the opening 13 side toward the side opposite to the opening 13, and the arc-shaped first reflective surfaces 31*a*, 31*b*, and 31*c* respectively arranged on the side opposite to the opening 13 of the transmissive surfaces 32*a*, 32*b*, and 32*c* so as to be inclined at acute angles.

More specifically, the transmissive surface 32*c* farthest from the opening 13 among the transmissive surfaces 32 is a fan-shaped transmissive surface centered on the Z-axis 12. The first reflective surface 31*c* farthest from the opening 13 among the first reflective surfaces 31 is arranged to reflect light that has passed through the transmissive surface 32*c* toward an arc-shaped region (first region) with the angle θ of a peripheral portion 18 surrounding the Z-axis 12. The first reflective surface 31*c* is located on the side opposite to the opening 13 of the transmissive surface 32*c* to form a substantially fan-shaped inverted truncated cone centered on the Z-axis 12 and to be inclined relative to the X-Y plane and reflects the light 7 with an optical axis 7*a* parallel to the Z-axis 12 toward the direction 19 orthogonal to the Z-axis 12. The first reflective surface 31*b* is an arc-shaped reflective surface located between an inner edge 32*b*1 of the transmissive surface 32*b* and an outer edge 32*c*2 of the transmissive surface 32*c* to reflect the light 7 that has passed through the transmissive surface 32*b*. The first reflective surface 31*a* is an arc-shaped reflective surface located between an inner edge 32*a*1 of the transmissive surface 32*a* and an outer edge 32*b*2 of the transmissive surface 32*b* to reflect the light 7 that has passed through the transmissive surface 32*a*.

The outer surface 15 of the light-transmissive member 11 may be a cylindrical surface or may be optimized as a toric free-form surface such that light reflected by the first reflective surfaces 31*a* to 31*c* and the fourth reflective surface 24 and light transmitted through the transmissive surface 33 are more uniformly emitted.

In the optical device 10, the second reflective surface 22 and the third reflective surface 23 of the reflector 20 are in close contact with lateral surfaces 17*a* and 17*b* of the light-transmissive member 11, and the fourth reflective surface 24 is located above (in the positive direction of the Z-axis) the first reflective surface 31*c*.

Figure 5:
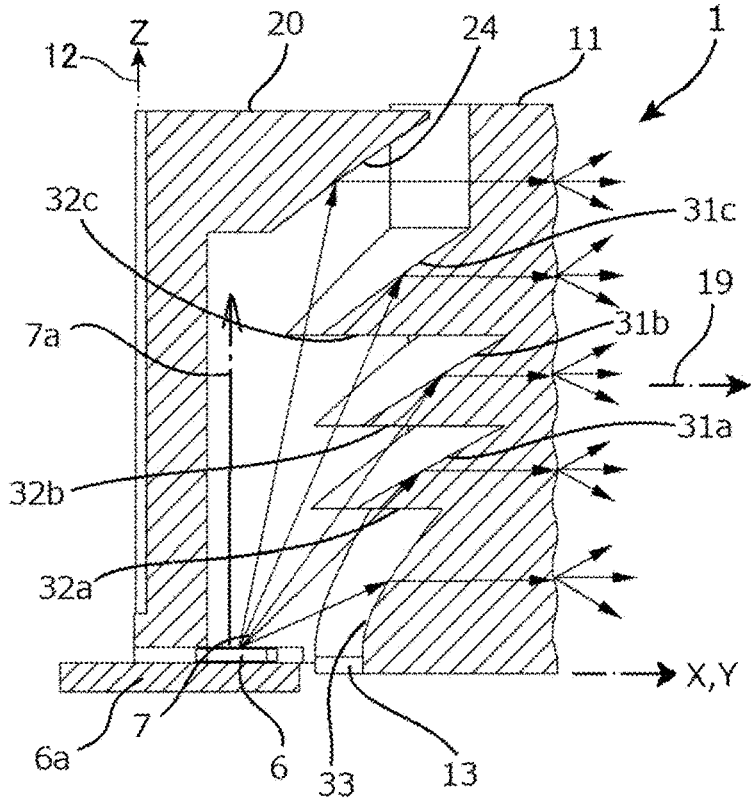
FIG. 5 schematically shows reflection of incident light by a light-transmissive member and a reflector.

As shown in FIG. 4 and FIG. 5, the illumination device 1 includes the optical device 10 and a substrate 6*a* attached to the opening 13 of the light-transmissive member 11. The LED 6 is mounted on the substrate 6*a*, and the light 7 for illumination emitted from the LED 6 in the opening 13 travels toward the first reflective surfaces 31 in the space 14 of the light-transmissive member 11 along and parallel to the Z-axis 12. The first reflective surfaces 31 composed of the separate reflective surfaces 31*a* to 31*c* are arranged so as to reflect, to the first region with the central angle θ of the peripheral portion 18 surrounding the Z-axis 12, the light (first light) 7 for illumination with a light distribution characteristic with the optical axis 7*a* parallel to the Z-axis 12. The optical device 10 has the first reflective surfaces 31 and includes the reflector 20 having the second reflective surface 22 and the third reflective surface 23 intersecting each other on the Z-axis 12 such that the first reflective surfaces 31 are located therebetween. The second reflective surface 22 reflects the first light 7 to the peripheral portion 18 surrounding the Z-axis 12 toward the first reflective surfaces 31. The third reflective surface 23 reflects the light 7 from the LED 6 to the peripheral portion 18 surrounding the Z-axis 12 in a direction opposite to the direction of reflection by the second reflective surface 22. Similarly to the first reflective surfaces 31, the fourth reflective surface 24 of the reflector 20 reflects, to the first region with the central angle θ of the peripheral portion 18 surrounding the Z-axis 12, the light (first light) 7 for illumination having a light distribution characteristic with the optical axis 7*a* parallel to the Z-axis 12.

Accordingly, in the optical device 10, the second reflective surface 22 and the third reflective surface 23 intersecting each other on the Z-axis 12 at the central angle θ reciprocally reflect (fold), toward the first reflective surfaces 31 and the fourth reflective surface 24 in the region with the angle θ, the light 7 emitted from the LED 6 serving as the light source along the Z-axis 12. The optical device 10 emits light to the region with the angle θ around the Z-axis 12 in a direction perpendicular to the Z-axis 12 using the first reflective surfaces 31 and the fourth reflective surface 24.

In order to take in the first light 7 at a position farther from the LED 6, the light-transmissive member 11 has the transmissive surfaces 32*a*, 32*b*, and 32*c* sequentially arranged along the first axis (Z-axis) 12 such that the area gradually increases from the opening 13 side toward the side opposite to the opening 13. The larger the area of the transmissive surface is, the larger the thickness of the light-transmissive member 11 in the X-Y plane becomes. The uppermost portion of the light-transmissive member 11 having the transmissive surface 32*c* therefore has the largest thickness.

In the present embodiment, both of the first reflective surfaces 31 of the light-transmissive member 11 and the fourth reflective surface 24 of the reflector 20 are used as reflective surfaces that reflect light in a direction perpendicular to the Z-axis 12. Specifically, the fourth reflective surface 24 of the reflector 20 is located above the uppermost first reflective surface 31*c*. The reflector 20 has the uppermost reflective surface, so that thickness of a thick portion of the light-transmissive member in the X-Y plane can be reduced compared with the case in which only the light-transmissive member 11 constitutes reflective surfaces. Reduction in the thickness of the thick portion can reduce the time required to mold the light-transmissive member 11. The volume of the light-transmissive member 11 can also be reduced.

The second reflective surface 22 and the third reflective surface 23 are disposed to reflect the light 7 from the LED 6 to the region with the angle θ and are disposed at least near the LED 6. The reflective surfaces 22 and 23 may intersect the first reflective surfaces 31 and the fourth reflective surface 24, which allows for efficient reflection of the light 7 from the LED 6 toward the first reflective surfaces 31 and the fourth reflective surface 24 without leakage.

FIG. 5 schematically shows a configuration in which the light (incident light) 7 incident along the Z-axis 12 is reflected by the first reflective surfaces 31 and the fourth reflective surface 24 and emitted from the light-transmissive member 11 of the optical device 10 in the direction 19 orthogonal to the Z-axis 12. The light emitted from the LED (light source) 6 has a Lambertian light distribution centered on the optical axis 7*a*. A component of the light around the optical axis 7*a* is reflected by the second reflective surface 22 and the third reflective surface 23 toward the fan-shaped light-transmissive member 11 with the central angle θ. As shown in FIG. 5, a light distribution angle component of the light with respect to the optical axis 7*a* is divided by the transmissive surfaces 32*a* to 32*c* and the separate first reflective surfaces 31*a* to 31*c* of the light-transmissive member 11 and the fourth reflective surface 24 into a plurality of groups (pencils of rays), and the pencils of rays are emitted in the direction 19 orthogonal to the optical axis 7*a*. A component of the light emitted from the LED 6 at a large light distribution angle is emitted in the direction 19 orthogonal to the optical axis 7*a* through the transmissive surface 33 near the opening 13 of the light-transmissive member 11.

Accordingly, the optical device 10 can convert the light with the Lambertian light distribution into illumination light 3 with a light distribution appropriate for illumination of a linear or quadrangular region by allowing the first reflective surfaces 31, the fourth reflective surface 24, the second reflective surface 22, and the third reflective surface 23 to reflect the light in the direction 19 orthogonal to the optical axis 7*a* to form an arc shape. Further, the first reflective surfaces 31 and the fourth reflective surface 24 reflect light in the direction 19 orthogonal to the optical axis 7*a* to convert the light into light traveling in a direction orthogonal to the optical axis 7*a*, so that a portion having a common luminous intensity in the Lambertian light distribution, in which the luminous intensity varies according to the light distribution angle around the optical axis 7*a*, can be extended from one end to the other end of a linear or quadrangular light distribution. For example, the light (pencil of rays) on the optical axis 7*a* with the highest luminous intensity can be extended from one end to the other end of a linear or quadrangular light distribution. Accordingly, a linear or quadrangular light distribution with a more uniform luminous intensity distribution can be obtained by controlling the curvature or inclination of the first reflective surfaces to control the luminous intensity in the width direction of the linear or quadrangular shape.

In the example above, the light-transmissive member 11 having the first reflective surfaces 31 constituted of three separate reflective surfaces has been described, but the first reflective surfaces 31 may be constituted of two reflective surfaces or four or more reflective surfaces. While a fan-shaped light-transmissive member 11 with a central angle (opening angle) θ of 90° has been described in the example above, the central angle θ may be 90° or less or 90° or more. The LED 6 used for the light source is not limited to a single LED 6; rather, a plurality of LEDs having multiple emission colors may be used for the light source.

Figure 6A:
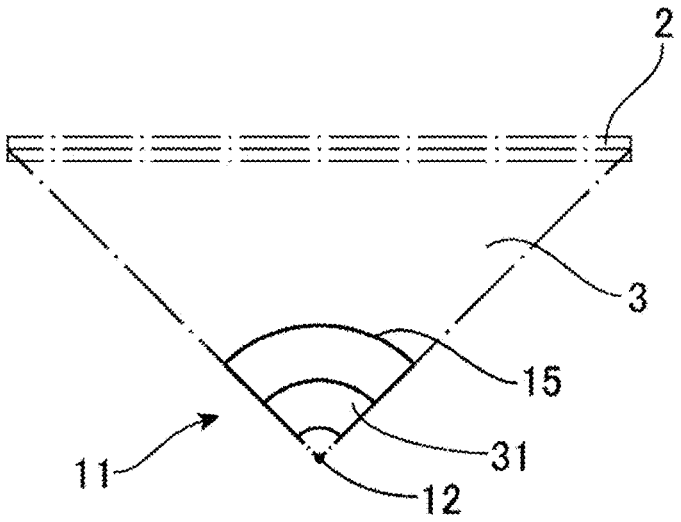
FIG. 6A and FIG. 6B are a schematic plan view and a schematic cross-sectional view of a light-transmissive member, respectively, showing an example of the relationship between a region to be illuminated and the light-transmissive member.
Figure 6B:
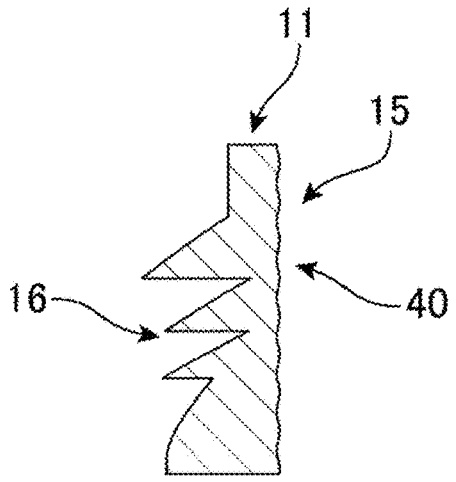

FIG. 6A to FIG. 9C schematically show several examples of the light-transmissive member 11 for the illumination device appropriate for regions 2 having different shapes or constitutions. The light-transmissive member 11 shown in FIGS. 6A and 6B emits illumination light 3 with a normal divergence, or what is called a medium light distribution, in the horizontal direction. As shown in FIG. 6A, the outer surface (emission surface) 15 of the light-transmissive member 11 has an arc shape expanding around the first axis 12 at the center. As shown in the schematic cross-sectional view of FIG. 6B, the emission surface 15 of the light-transmissive member 11 has periodic irregularities 40 for controlling the divergence of the illumination light 3 in the vertical direction along the first axis 12.

Figure 7A:
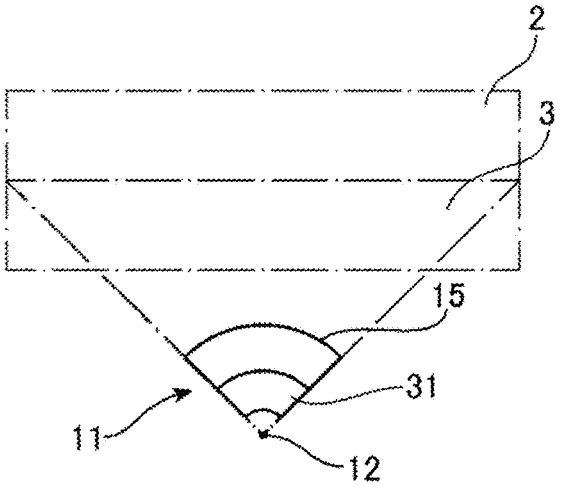
FIG. 7A to FIG. 7C are a schematic plan view, a schematic cross-sectional view, and another schematic cross-sectional view of a light-transmissive member, respectively, showing another example of the relationship between a region to be illuminated and the light-transmissive member.
Figure 7B:
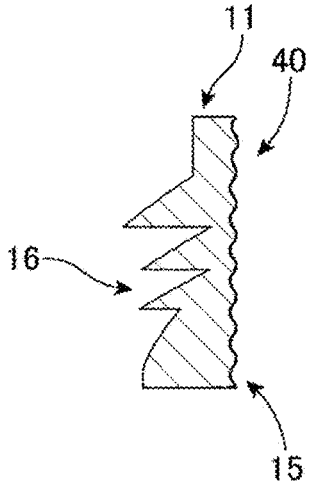
Figure 7C:
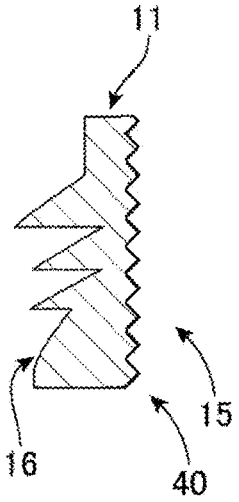

The light-transmissive member 11 shown in FIGS. 7A to 7C is an example of a light-transmissive member 11 that emits illumination light 3 with a medium light distribution or divergence in the horizontal direction while having a wide divergence in the vertical direction along the first axis 12. As shown in FIG. 7A, the outer surface (emission surface) 15 of the light-transmissive member 11 has an arc shape expanding around the first axis 12 at the center. As shown in the schematic cross-sectional view of FIG. 7B, the amplitude of the periodic irregularities 40 on the emission surface 15 of the light-transmissive member 11 may be larger than the amplitude of the irregularities 40 shown in FIG. 6B. The periodic irregularities 40 may be a collection of curved surfaces like a sine wave as shown in FIG. 7B, or may be a collection of straight lines (slopes) at different angles like a zigzag as shown in FIG. 7C.

Figure 8A:
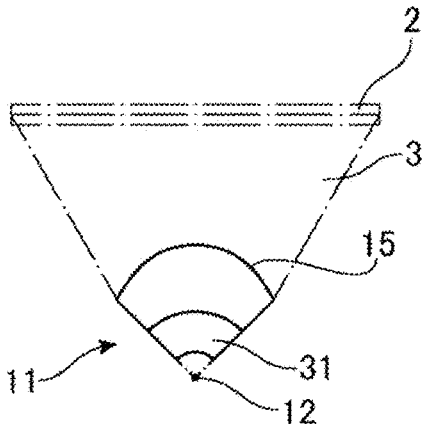
FIGS. 8A to 8C schematically show different examples of the relationship between a region to be illuminated and a light-transmissive member, in which FIG. 8A schematically shows an optical element with a narrow light distribution, FIG. 8B schematically shows an optical element with a broad light distribution, and FIG. 8C schematically shows an example of an optical element appropriate for illumination of a circular region.
Figure 8B:
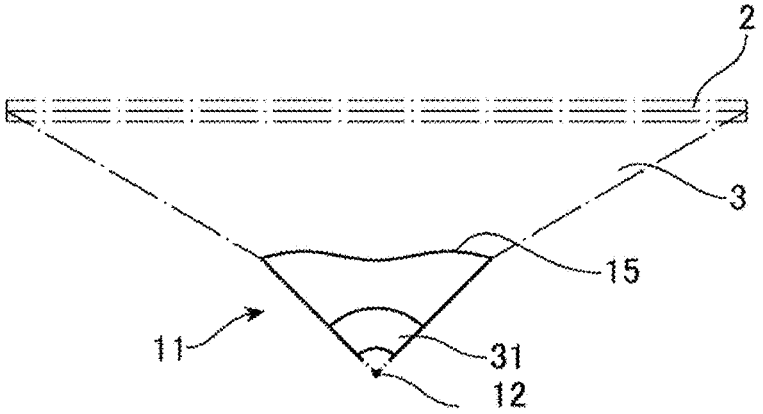
Figure 8C:
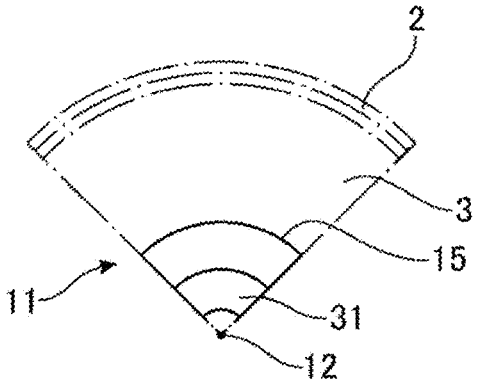

The light-transmissive member 11 shown in FIG. 8A is an example appropriate for illumination of a region 2 that is narrow in the horizontal direction. The emission surface 15 of the light-transmissive member 11 has a shape, such as a surface with a large curvature (small curvature radius), appropriate for emission of illumination light 3 with a narrow light distribution. The light-transmissive member 11 shown in FIG. 8B is an example appropriate for illumination of a region 2 that is large (long) in the horizontal direction. For example, the light distribution angle is increased by providing one or more irregularities also in the circumferential direction. As shown in FIG. 8B, the emission surface 15 can be designed to be recessed at an opening angle of 0° and to protrude on both sides in a cross section (cross section in the horizontal direction or in a plan view) in a direction perpendicular to the first axis 12. The light-transmissive member 11 having the emission surface 15 having a bifoliolate or protruding-recessed-protruding shape in a cross section in the horizontal direction is appropriate for emission of illumination light 3 with a broad light distribution for illuminating the region 2 that is long in the horizontal direction. The light-transmissive member 11 shown in FIG. 8C is an example appropriate for illumination of a linear region 2 extending in the circumferential direction on the inner surface of a cylindrical column.

Figure 9A:
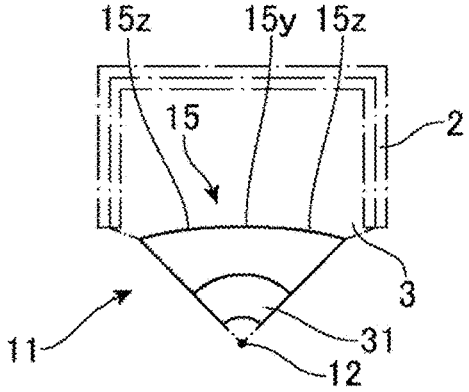

The light-transmissive member 11 shown in FIG. 9A is an example appropriate for illumination of a three-dimensional surface (region) 2 constituted of a plurality of linear surfaces combined into a U shape. The emission surface 15 of the light-transmissive member 11 includes, in a cross section in a direction perpendicular to the first axis 12, a portion 15*y* that forms a straight line or a curved line convex or concave with a large curvature radius at the position at an opening angle of 0° facing the center of the U shape, and protruding portions 15*z* corresponding to positions of the U-like shape bent at right angles. Employing such a shape of the emission surface 15 allows for provision of the light-transmissive member 11 appropriate for linear and uniform illumination of the U-shaped inner wall.

Figure 9B:
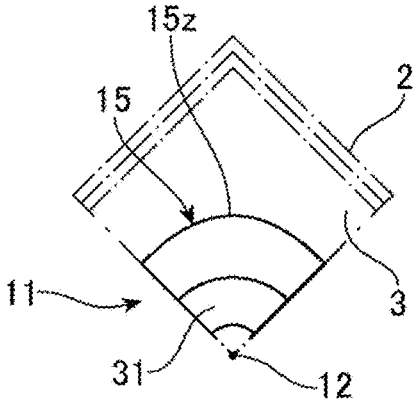

The light-transmissive member 11 shown in FIG. 9B is an example appropriate for illumination of a three-dimensional surface (region) 2 constituted of a plurality of linear surfaces combined into a V shape. The emission surface 15 of the light-transmissive member 11 has, in a cross section in a direction perpendicular to the first axis 12, a protruding portion 15*z* protruding toward a portion corresponding to the position at which the surfaces intersect each other to form the V shape. Employing such a shape of the emission surface 15 allows for provision of the light-transmissive member 11 appropriate for linear and uniform illumination of the V-shaped inner wall.

Figure 9C:
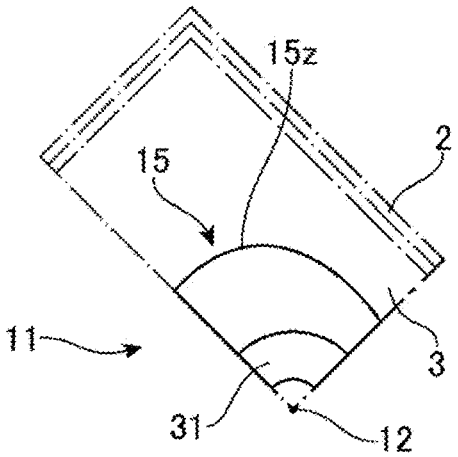

The light-transmissive member 11 shown in FIG. 9C is an example appropriate for illumination of a three-dimensional surface (region) 2 constituted of a plurality of linear surfaces asymmetrically combined into an L shape. The emission surface 15 of the light-transmissive member 11 has, in a cross section in a direction perpendicular to the first axis 12, a protruding portion 15*z* protruding toward a portion corresponding to the position at which the surfaces intersect each other to form the L shape. Employing such an asymmetric shape of the emission surface 15 around the first axis 12 allows for provision of the light-transmissive member 11 appropriate for linear and uniform illumination of the L-shaped inner wall.

Controlling the shape of the emission surface (outer surface) 15 in a cross section in a direction along the first axis 12 and the shape of the emission surface 15 in a cross section in a direction perpendicular to the first axis 12 as described above allows for emission of the illumination light 3 having different light distribution characteristics. Thus, the illumination device 1 including the light-transmissive member 11 having such an emission surface 15 can more uniformly illuminate linear regions 2 to be illuminated with various constitutions.

While certain embodiments of an optical device and an illumination device using the optical device have been described above, the present invention is not limited the description above, and should be broadly construed on the basis of the claims. The present invention also encompasses variations and modifications that are made on the basis of the description above.

The invention claimed is:

1. An optical device comprising:

a light-transmissive member having a first transmissive surface, a first reflective surface, and an outer surface, wherein the first transmissive surface and the first reflective surface are arranged along a first axis; and a reflector having:

a second reflective surface and a third reflective surface intersecting each other on the first axis and disposed such that the first reflective surface is located between the second reflective surface and the third reflective surface, and a fourth reflective surface disposed between the second reflective surface and the third reflective surface;

wherein the optical device is configured such that, when light having an optical axis parallel to the first axis is emitted in the optical device, the first transmissive surface receives a first portion of the light, the first reflective surface reflects the first portion of the light to the outer surface such that the first portion of the light illuminates an arc-shaped region that is around the first axis and outside of the optical device, and the fourth reflective surface reflects a second portion of the light to the outer surface such that the second portion of the light illuminates the arc-shaped region.

2. The optical device according to claim 1, wherein at least one of the second reflective surface and the third reflective surface intersects the first reflective surface.

3. The optical device according to claim 1, wherein the first reflective surface comprises a plurality of reflective surfaces separated from each other in a direction along the first axis.

4. The optical device according to claim 3, wherein the first transmissive surface comprises a plurality of transmissive surfaces separated from each other in a direction along the first axis, wherein the light-transmissive member has a multilevel inner surface comprising the plurality of reflective surfaces and the plurality of transmissive surfaces respectively corresponding to the plurality of reflective surfaces, and wherein the light-transmissive member has a fan shape in a cross section perpendicular to the first axis.

5. The optical device according to claim 4, wherein the light-transmissive member has a plurality of emission surfaces corresponding to the plurality of reflective surfaces.

6. The optical device according to claim 4, wherein the light-transmissive member has a second transmissive surface configured to transmit a portion of the light in a lowermost portion closest to an incident side of the multilevel inner surface.

7. The optical device according to claim 3, wherein the light-transmissive member has a plurality of emission surfaces corresponding to the plurality of reflective surfaces.

8. The optical device according to claim 7, wherein the plurality of emission surfaces each include a portion curved in a cross section perpendicular to the first axis.

9. The optical device according to claim 8, wherein the plurality of emission surfaces have periodic irregularities in a cross section in the direction along the first axis.

10. The optical device according to claim 7, wherein the plurality of emission surfaces have periodic irregularities in a cross section in the direction along the first axis.

11. The optical device according to claim 1, wherein the first reflective surface is located closer to an incident side than the fourth reflective surface.

12. An illumination device comprising:

the optical device according to claim 1; and a light source configured to emit the light.

13. The optical device according to claim 1, wherein the first reflective surface has a shape of an arc that extends continuously from the second reflective surface to the third reflective surface.

14. The optical device according to claim 13, wherein the first transmissive surface has a shape of an arc that extends continuously from the second reflective surface to the third reflective surface.

* * * * *